US007407014B2

(12) United States Patent
Thompson

(10) Patent No.: US 7,407,014 B2
(45) Date of Patent: Aug. 5, 2008

(54) AUTOMOTIVE ONBOARD FIRE SUPPRESSION SYSTEM RESERVOIR WITH INTERNAL REINFORCEMENT

(75) Inventor: Robert Thompson, Redford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/609,063

(22) Filed: Dec. 11, 2006

(65) Prior Publication Data

US 2007/0084610 A1 Apr. 19, 2007

Related U.S. Application Data

(63) Continuation-in-part of application No. 10/907,134, filed on Mar. 22, 2005, now Pat. No. 7,198,111.

(51) Int. Cl.

| | |
|---|---|
| ***A62C 3/07*** | (2006.01) |
| ***A62C 35/00*** | (2006.01) |
| ***B05B 9/04*** | (2006.01) |
| ***B65D 1/42*** | (2006.01) |
| ***B65D 6/34*** | (2006.01) |
| ***B65D 8/08*** | (2006.01) |

(52) U.S. Cl. ..... 169/62; 169/9; 239/373; 220/651; 220/653

(58) Field of Classification Search ..... 169/9, 169/16, 54, 56, 62, 71, 84, 85; 239/172, 239/337, 373; 220/62.19, 592, 651–653
See application file for complete search history.

(56) References Cited

U.S. PATENT DOCUMENTS

| | | | | |
|---|---|---|---|---|
| 3,897,828 | A * | 8/1975 | Glover | 169/43 |
| 4,132,271 | A | 1/1979 | Mikaila | |
| 5,129,386 | A | 7/1992 | Meister | |
| 5,590,718 | A | 1/1997 | Bertossi | |
| 5,613,564 | A | 3/1997 | Rhines | |
| 5,762,145 | A | 6/1998 | Bennett | |
| 5,808,541 | A | 9/1998 | Golden | |
| 5,918,681 | A | 7/1999 | Thomas | |
| 5,934,379 | A | 8/1999 | Ostlyngen et al. | |
| 5,960,888 | A | 10/1999 | Moore, Sr. | |
| 5,984,016 | A * | 11/1999 | Samuelsson | 169/62 |
| 5,992,528 | A | 11/1999 | Parkinson et al. | |
| 6,164,383 | A | 12/2000 | Thomas | |
| 6,189,624 | B1 * | 2/2001 | James | 169/61 |
| 6,352,121 | B1 | 3/2002 | Pitell et al. | |
| 6,981,555 | B2 | 8/2003 | Smith et al. | |
| 2004/0084193 | A1 | 5/2004 | Tseng | |
| 2004/0226726 | A1 | 11/2004 | Holland et al. | |

* cited by examiner

*Primary Examiner*—Darren W Gorman
(74) *Attorney, Agent, or Firm*—Dickinson Wright PLLC; Gigette Bejin

(57) ABSTRACT

An automotive vehicle includes a vehicle body and at least one reservoir containing a fire suppressant agent. A distribution system receives the fire suppression agent from the reservoir and conducts the agent to at least one location about the vehicle's body in response to the determination by a sensor system and controller that the vehicle has been subjected to a significant impact. The reservoir includes a discharge port which is positioned in part by a tensile member extending through the reservoir to an anchor incorporated in an external wall section of the reservoir.

16 Claims, 9 Drawing Sheets

AUTOMOTIVE ONBOARD FIRE SUPPRESSION SYSTEM RESERVOIR WITH INTERNAL REINFORCEMENT

RELATED APPLICATIONS

This application is a continuation-in-part of U.S. patent application Ser. No. 10/907,134, filed Mar. 22, 2005.

BACKGROUND OF THE INVENTION

1. Field of the Invention

The present invention relates to an automotive vehicle having an onboard apparatus for suppressing a vehicle fire.

2. Disclosure Information

Police vehicles are subject to increased exposure to collisions, particularly high-speed rear-end collisions, arising from the need for police officers to stop on the shoulders, or even in the traffic lanes, of busy highways. Unfortunately, other motorists are known to collide with police vehicles employed in this manner. These accidents can compromise the fuel system on any vehicle and may cause fires. The present system is designed to suppress the spread of, or potentially, to extinguish such a fire. U.S. Pat. No. 5,590,718 discloses an anti-fire system for vehicles in which a number of fixed nozzles are furnished with a fire extinguishing agent in response to an impact sensor. The system of the '718 patent suffers from a problem in that the fixed nozzles are not suited to the delivery of the extinguishing agent at ground level. Also, the '718 patent uses a valving system which could become clogged and therefore inoperable. U.S. Pat. No. 5,762,145 discloses a fuel tank fire protection device including a powdered extinguishing agent panel attached to the fuel tank. In general, powder delivery systems are designed to prevent ignition of fires and are deployed upon impact. As a result, the powder may not be able to follow the post-impact movement of the struck vehicle and may not be able to prevent the delayed ignition or re-ignition of a fire.

The present fire suppression system provides significant advantages, as compared with prior art vehicular fire suppression systems.

SUMMARY OF THE INVENTION

According to one aspect of the present invention, an onboard fire suppression system includes at least one fiber reinforced composite reservoir containing a fire suppression agent. A propellant, operatively associated with the reservoir, expels the suppression agent from the reservoir. A propellant may be located either inside the reservoir or externally thereto.

A discharge port extends through a first wall section of the reservoir. A distribution system receives fire suppression agent expelled from the reservoir and distributes the depressant agent in at least one location external to a vehicle. The distribution system is connected to the discharge port. A retaining system, located within the reservoir, maintains the discharge port in registry with the first wall section. The retaining system includes an anchor incorporated in a second wall section opposing the first wall section, and a tensile member extending through the interior of the reservoir, with the tensile member being attached to the anchor and to the discharge port.

In a first embodiment, the discharge port, the anchor, and the tensile member all comprise metallic members. These metallic members may be fabricated from either ferrous or non-ferrous metals. The tensile member is preferably pretensioned. The tensile member may be configured as a number of separate cable elements, with each of the elements having a first end attached to the anchor and a second end attached to the discharge port.

According to another aspect of the present invention, the reservoir may include a fill port extending through a third wall section of the reservoir. A secondary anchor incorporated in a fourth wall section opposing the third wall section, and an added tensile member extending through the interior of the reservoir maintain the fill port in proper registry with the third wall section of the reservoir.

According to another aspect of the present invention, a discharge port includes a flanged inner portion and a threaded outer portion having a threaded fastener attached thereto to serve as an abutment facing the outer surface of the first wall section, through which the discharge port extends.

According to another aspect of the present invention, a method for constructing an internally reinforced reservoir for an onboard fire suppression system includes forming a reservoir body, including at least one discharge port located in a first wall section of the reservoir body, followed by extending a tensile member from the discharge port to a second wall section of the reservoir body. Then, the tensile member is tensioned and affixed to the second wall section so that the tension member remains in tension during standby operation of the reservoir. As used herein, the term "standby operation" means operation during any period of time in which the onboard fire suppression system is available for service, but waiting for the signal from a controller to activate the propellant, so as to cause discharge of the suppressant agent onto a location in or about a vehicle, including at least one external location.

Other advantages, as well as features of the present invention will become apparent to the reader of this specification.

DETAILED DESCRIPTION OF THE PREFERRED EMBODIMENTS

Figure 1:
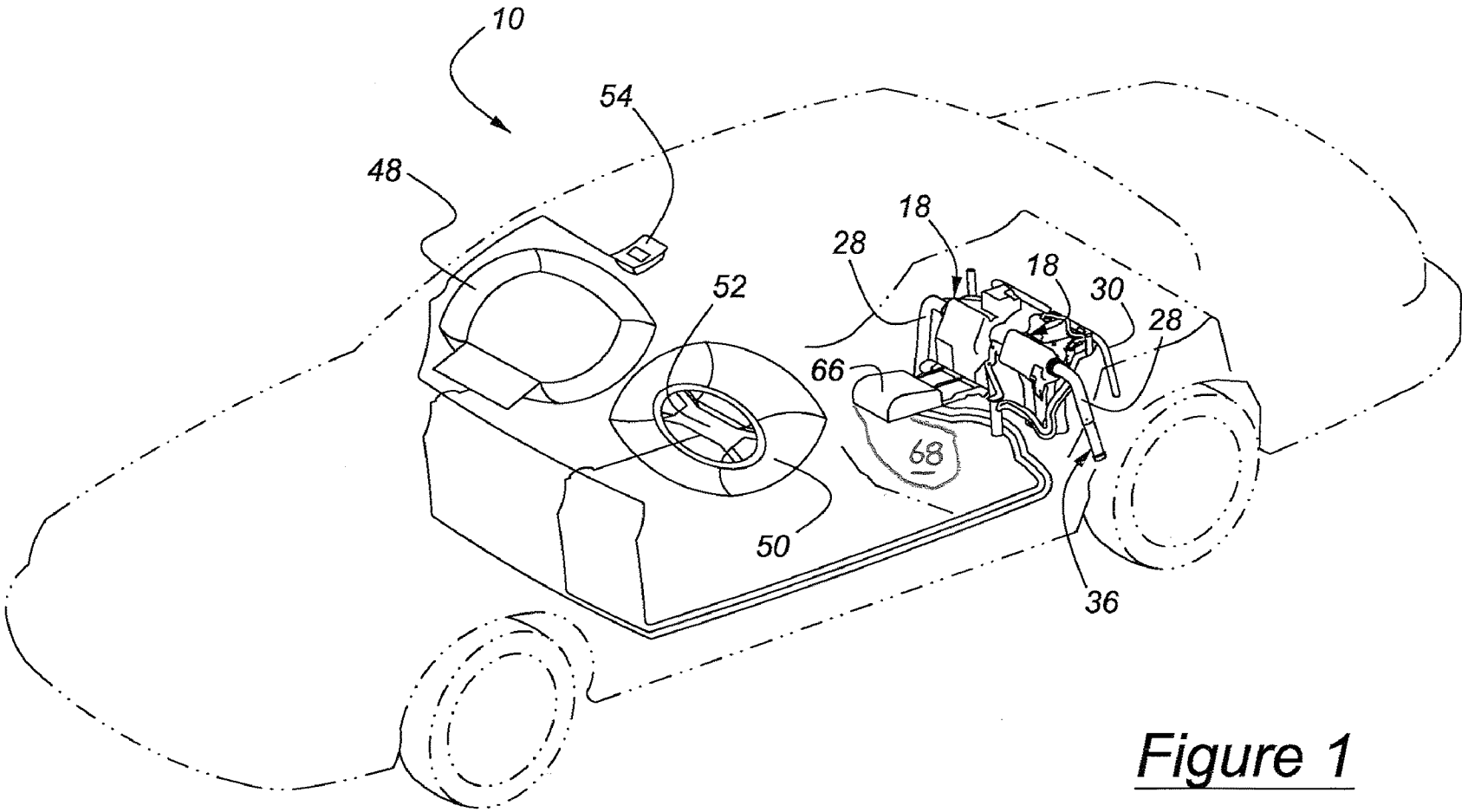
FIG. 1 is a ghost perspective view of an automotive vehicle having a fire suppression system according to the present invention.

As shown in FIG. 1, vehicle 10 has a passenger airbag restraint 48 and a driver's airbag restraint 50 mounted adjacent steering wheel 52. A fire suppression system includes controller 66 which is mounted upon floor pan 68 of vehicle 10, and reservoirs 18 which are mounted under floor pan 68 in the so-called kick-up area adjoining the rear axle of vehicle 10. Those skilled in the art will appreciate in view of this disclosure that additional passenger restraint devices, such as seat belt pretensioners and side airbags, may be installed in a vehicle and controlled at least in part by, or in conjunction with, controller 66.

Figure 2:
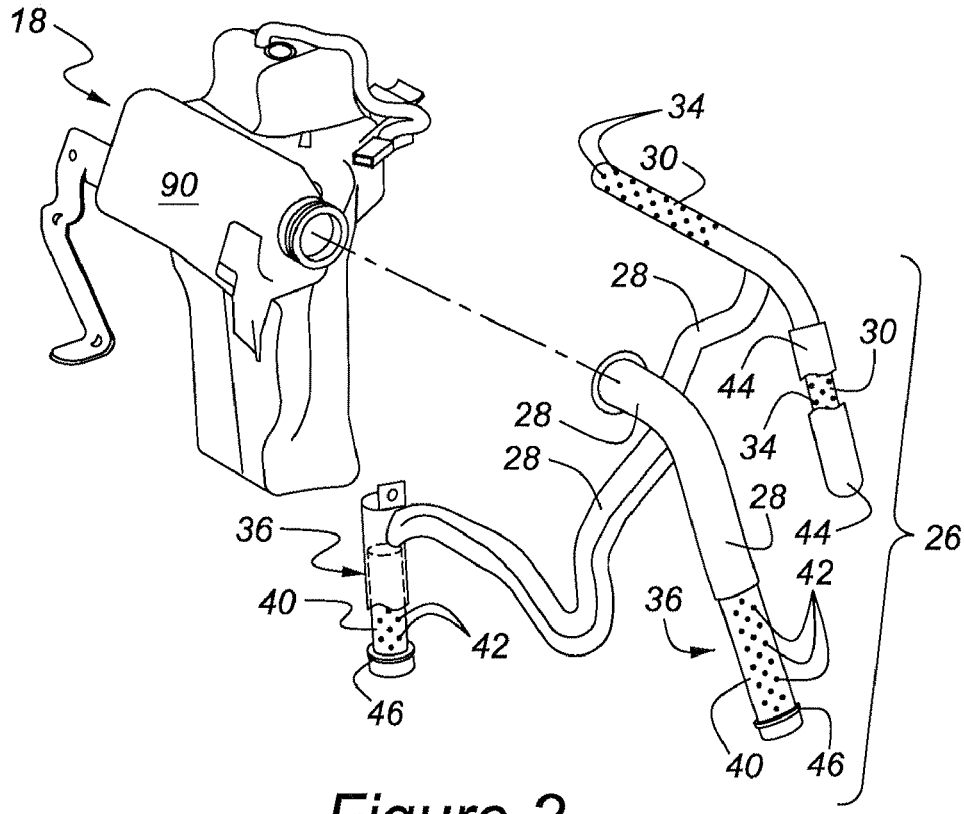
FIG. 2 is an exploded perspective view of a portion of a fire suppression system according to the present invention.
Figure 8:
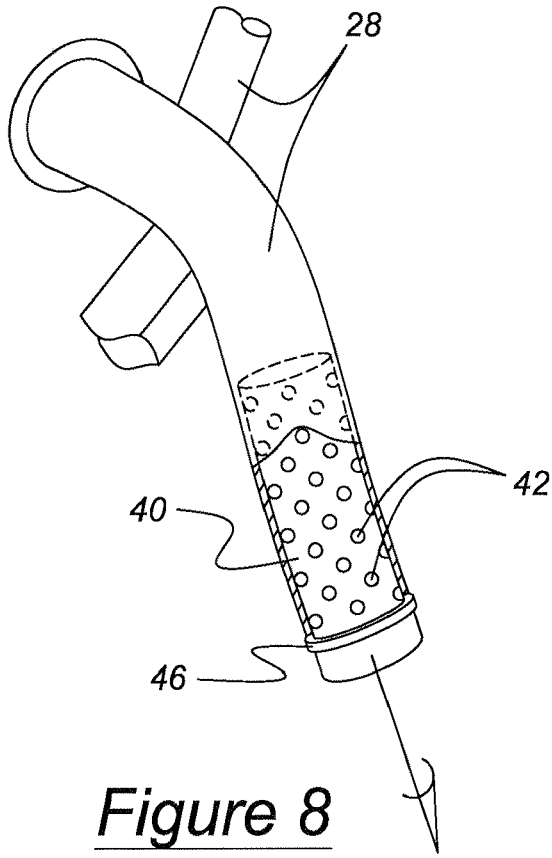
FIG. 8 is a perspective view of a variable geometry fire suppression agent nozzle according to one aspect of the present invention.

FIG. 1 shows not only reservoirs 18 but also a portion of right and left side fire suppression conduits 28, as well as fixed geometry nozzles 30 and variable geometry nozzles 36. As seen in FIG. 1, variable geometry nozzles 36 project downwardly to allow fire suppression agent to be expelled from reservoirs 18 and placed at a low angle to the ground surface the vehicle is operating upon. This mode of operation is possible because variable geometry nozzles 36 are, as shown in FIG. 2, telescopingly extensible. This telescoping feature, which is shown in greater detail in FIG. 8, is produced by a sliding spray head, 40, which is slidingly engaged with conduit 28 such that gas pressure within conduit 28 forces spray head 40 downwardly into its extended position, causing fire suppression agent 22 to be discharged through a number of holes 42 formed in spray head 40. As shown in FIG. 2, at least two variable geometry nozzles 36 may be employed with single reservoir 18, along with at least two fixed nozzles 30 which are spray bars each having a number of orifices 34. While in their normally closed state, variable geometry nozzles 36 are liquid-tight by virtue of seals 46, which are interposed between an end of each of spray heads 40 and the corresponding ends of conduits 28. In a preferred embodiment, seals 46 comprise elastomeric boots attached to an outer surface of conduit 28. Seals 46 are simply sheared by the deploying spray head 40 when the present system is discharged. Fixed nozzles 30 are also rendered liquid-tight by covers 44, which are simply blown off when the present system is discharged. The sealing of nozzles 30 and 36 is important, because this prevents the ingress of road splash, which could block the system in sub-freezing weather or cause corrosion or blockage due to mud or other foreign matter.

Figure 7:
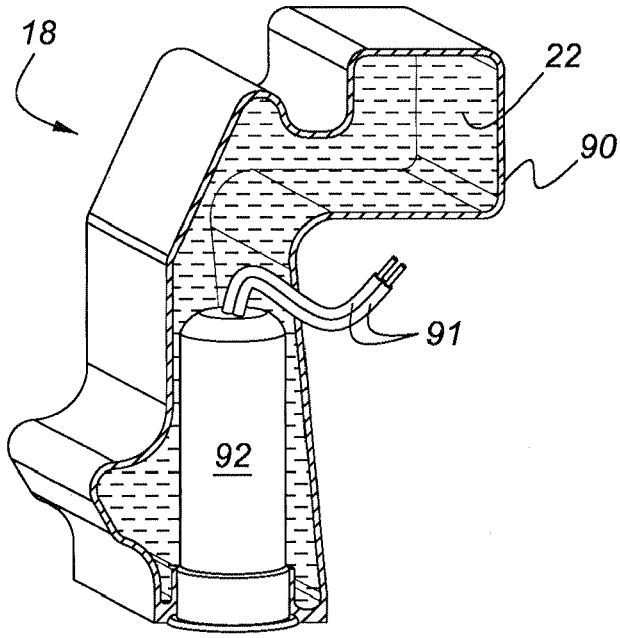
FIG. 7 is a cutaway perspective view of a fire suppression agent reservoir according to one aspect of the present invention.

Additional details of reservoir 18 are shown in FIG. 7. Tank 90 contains approximately 1.5 L of fire suppression agent 22, and a propellant 92. Propellant 92 includes two squibs (not shown) which are activated simultaneously by controller 66 via lines 91 so as to release a large amount of gas, forcing fire suppressant agent 22 from tank 90 and into distribution system 26, including conduit 28 and the various fixed and variable geometry nozzles. A preferred propellant, marketed by Primex Aerospace Company as model FS01-40, is a mixture including aminotetrazole, strontium nitrate, and magnesium carbonate. This is described in U.S. Pat. No. 6,702,033, which is hereby incorporated by reference into this specification.

Those skilled in the art will appreciate in view of this disclosure that other types of propellants could be used in the present system, such as compressed gas canisters and other types of pyrotechnic and chemical devices capable of creating a gas pressure force in a vanishingly small amount of time. Such propellants may be mounted either within a reservoir with the fire suppressant agent, or externally thereto. Moreover, fire suppressant agent 22, which preferably includes a water-based solution with hydrocarbon surfactants, fluorosurfactants, and organic and inorganic salts sold under the trade name LVS Wet Chemical Agent® by Ansul Incorporated, could comprise other types of agents such as powders or other liquids, or yet other agents known to those skilled in the art and suggested by this disclosure. If two reservoirs 18 are employed with a vehicle, as is shown in FIG. 1, all four squibs will be deployed simultaneously.

Figure 4:
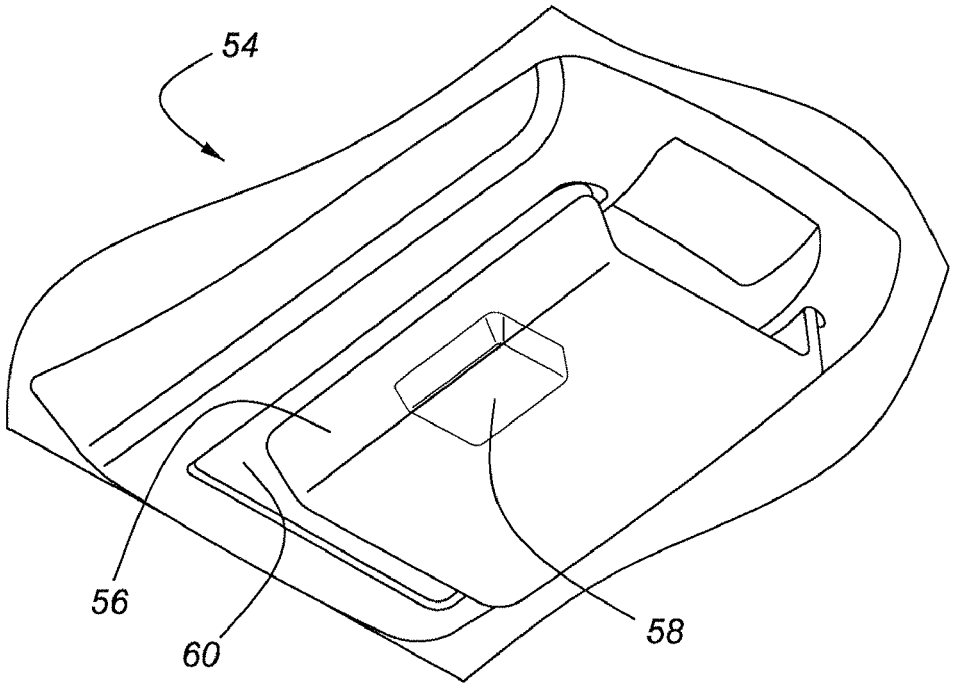
FIG. 4 is a perspective view of a manually activatable switch used with a fire suppression system according to the present invention.

FIG. 4 shows manually activatable switch 54 for use with the present system. As shown in FIG. 1, switch 54 may be advantageously located on the headliner of vehicle 10 between the sun visors, or at any other convenient position. To use this switch 54, hinged clear cover 56 is first opened by pressing on cover 56. Thereafter, the fire suppression system may be triggered by manually pressing pushbutton 58. If the vehicle occupants are not disposed to release cover 56, the system may be triggered by merely sharply depressing cover 56, thereby closing contacts (not shown) contained within platform 60.

Figure 3:
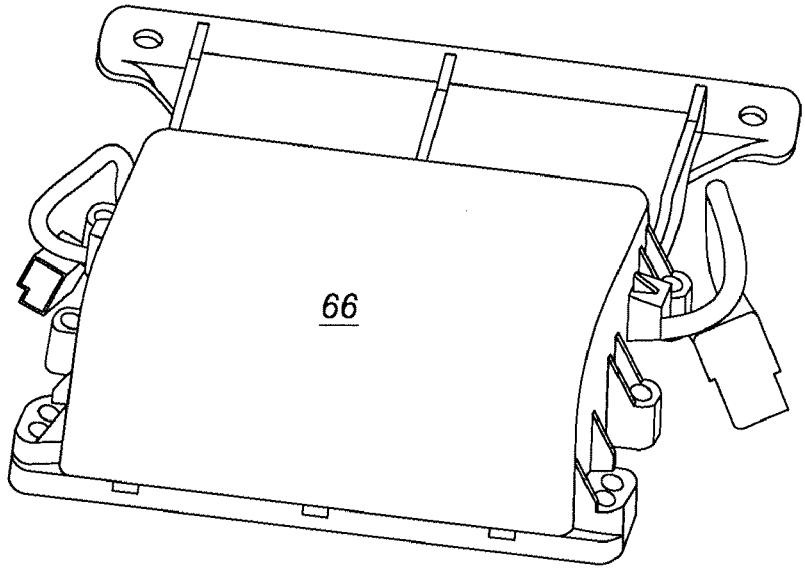
FIG. 3 is a perspective view of a control module used with a system according to the present invention.
Figure 5:
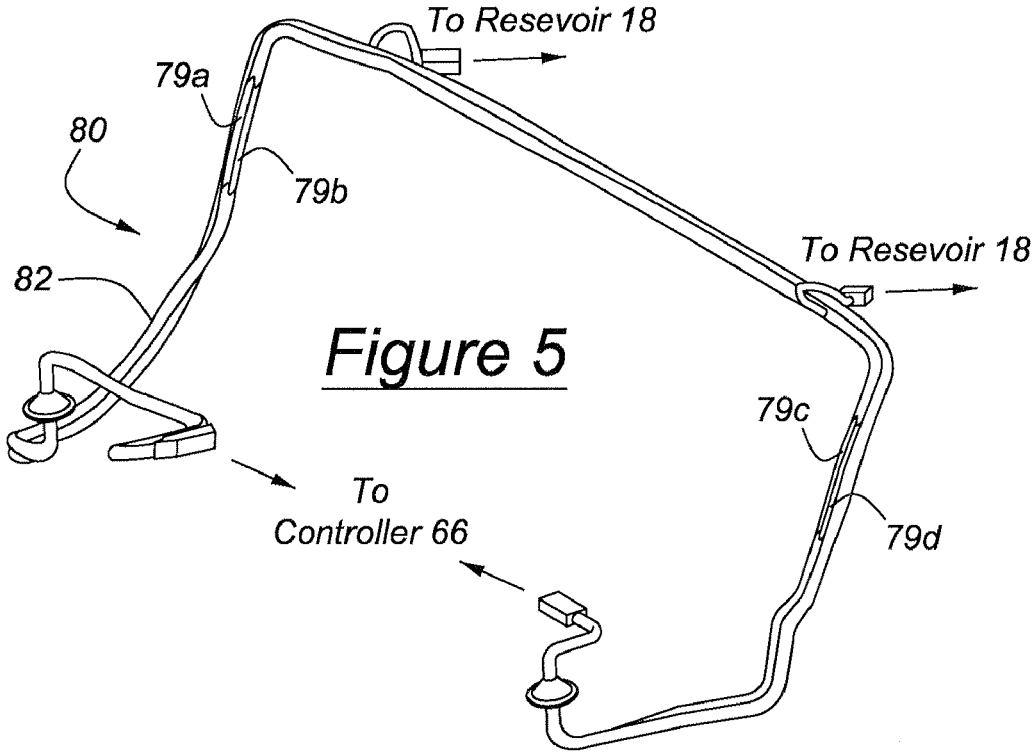
FIG. 5 illustrates a portion of a wiring harness used with the present system.

Because the present system is intended for use when the vehicle has received a severe impact, controller 66, which is shown in FIG. 3, contains a redundant power reserve or supply, which allows operation of the fire suppression system for about nine seconds, even if controller 66 becomes isolated from the vehicle's electrical power supply. Wiring harness 80, as shown in FIG. 5, is armored, and has a para-aramid fiber inner sheath, 82, of about 2 mm in thickness, which helps to shield the conductors within harness 80 from abrasion and cutting during a vehicle impact event. This para-aramid fiber is sold under the trade name KEVLAR® by the DuPont Company. This armoring helps to assure that communication between controller 66 and reservoirs 18 remains in effect during an impact event. Post-impact communications are further aided by redundancy in the control system. Specifically, four independent sets of primary conductors, 79*a-d*, extend from controller 66 to reservoirs 18 protected by sheath 82. Moreover, an H-conductor, shown at 81 in FIG. 5, extends between reservoirs 18. Thus, if one or both of the primary conductors 79*a-b*, or 79*c-d*, extending to one of reservoirs 18 should become severed, H-conductor 81 will be available to carry the initiation signal from the undamaged lines to both of reservoirs 18.

Figure 9:
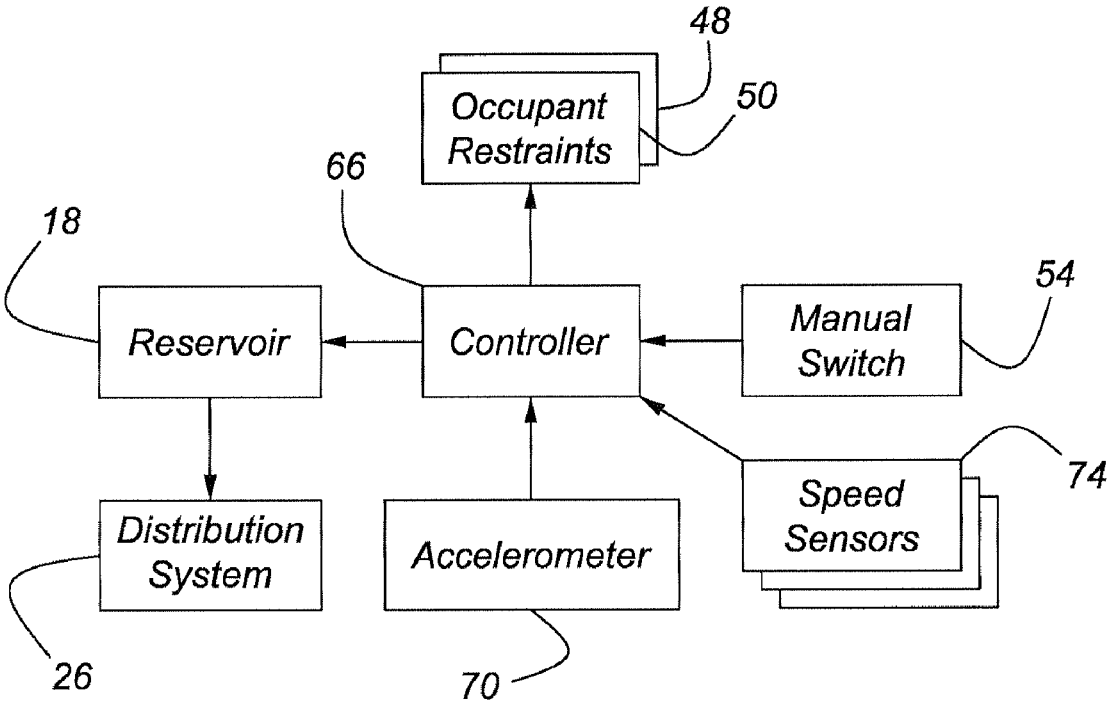
FIG. 9 is a block diagram of a fire suppression system and with additional components for occupant restraint according to one aspect of the present invention.

As noted above, an important feature of the present invention resides in the fact that the control parameters include not only vehicle impact, as measured by an accelerometer such as that shown at 70 in FIG. 9, but also vehicle speed, as measured by means of speed sensors 74, also shown in FIG. 9. Speed sensors 74 may advantageously be existing sensors used with an anti-lock braking system or vehicle stability system. Alternatively, speed sensors 74 could comprise a global positioning sensor or a radar or optically based ground-sensing system. Accelerometer 70, as noted above, could be used with a conventional occupant restraint airbag system, thereby maximizing use of existing systems within the vehicle. Advantageously, accelerometer 70 may be an amalgam of two or more accelerometers having differing sensing ranges. Such arrangements are known to those skilled in the art and suggested by this disclosure. At least a portion of the various sensors could either be integrated in controller 66 or distributed about vehicle 10.

Figure 6:
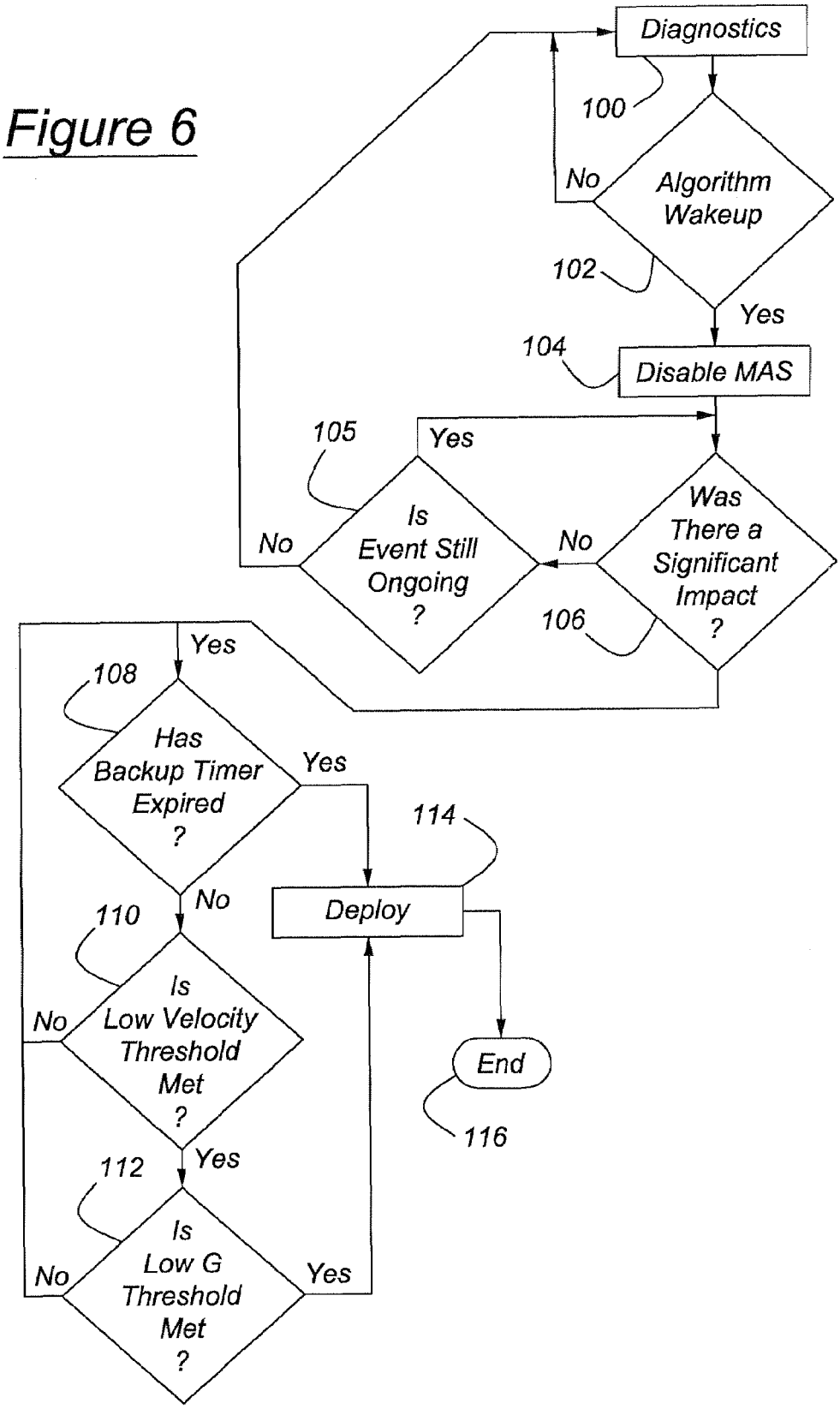
FIG. 6 is a flowchart showing a portion of the logic used to control a system according to the present invention.

FIG. 6 shows a sequence which is used according to one aspect of the present invention for activating a release of fire suppressant agent.

Beginning at block 100, controller 66 performs various diagnostics on the present system, which are similar to the diagnostics currently employed with supplemental restraint systems. For example, various sensor values and system resistances will be evaluated on a continuous basis. Controller 66 periodically moves to block 102, wherein the control algorithm will be shifted from a standby mode to an awake mode in the event that a vehicle acceleration, or, in other words, an impact, having a magnitude in excess of a relatively low threshold is sensed by accelerometer 70. Also, at block 102 a backup timer will be started. If the algorithm is awakened at block 102, controller 66 disables manually activatable switch 54 at block 104 for a predetermined amount of time, say 150 milliseconds. This serves to prevent switch 54 from inadvertently causing an out-of-sequence release of fire suppression agent. Note that at block 104, a decision has not yet been made to deploy fire suppression agent 22 as a result of a significant impact.

At block 106, controller 66 uses output from accelerometer 70 to determine whether there has been an impact upon vehicle 10 having a severity in excess of a predetermined threshold impact value. Such an impact may be termed a significant, or "trigger", impact. If an impact is less severe than a trigger impact, the answer at block 106 is "no", and controller 66 will move to block 105, wherein an inquiry is made regarding the continuing nature of the impact event. If the event has ended, the routine moves to block 100 and continues with the diagnostics. If the event is proceeding, the answer at block 105 is "yes", and the routine loops to block 106.

If a significant impact is sensed by the sensor system including accelerometer 70 and controller 66, the answer at block 106 will be "yes." If such is the case, controller 66 moves to block 108 wherein the status of a backup timer is checked. This timer was started at block 102.

Once the timer within controller 66 has counted up to a predetermined, calibratable time on the order of, for example, 5-6 seconds, controller 66 will cause propellant 92 to initiate delivery of fire suppressant agent 22, provided the agent was not released earlier. Propellant 92 is activated by firing an electrical squib so as to initiate combustion of a pyrotechnic charge. Alternatively, a squib may be used to pierce, or otherwise breach, a pressure vessel. Those skilled in the art will appreciate in view of this disclosure that several additional means are available for generating the gas required to expel fire suppressant agent 22 from tank 90. Such detail is beyond the scope of this invention. An important redundancy is supplied by having two squibs located within each of tanks 90. All four squibs are energized simultaneously.

The velocity of the vehicle 10 is measured at block 110 using speed sensors 74, and compared with a low velocity threshold. In essence, controller 66 processes the signals from the various wheel speed sensors 74 by entering the greatest absolute value of the several wheel speeds into a register. This register contains both a weighted count of the number of samples below a threshold and a count of the number of samples above the threshold. When the register value crosses a threshold value, the answer at block 110 becomes "yes." In general, the present inventors have determined that it is desirable to deploy fire suppression agent 22 prior to the vehicle coming to a stop. For example, fire suppression agent 22 could be dispersed when the vehicle slows below about 15 kph.

At block 112, controller 66 enters a measured vehicle acceleration value into a second register. Thereafter, once the acceleration register value decays below a predetermined low g threshold, the answer becomes "yes" at block 112, and the routine moves to block 114 and releases fire suppressant agent 22. In essence, a sensor fusion method combines all available sensor information to verify that the vehicle is approaching a halt. The routine ends at block 116. Because the present fire suppression system uses all of the available fire suppression agent 22 in a single deployment, the system cannot be redeployed without replacing at least reservoirs 18.

FIG. 6 does not include the activation of occupant restraints 48 and 50, it being understood that known control sequences, having much different timing constraints, may be employed for this purpose. In point of contrast, the low velocity threshold allows the present system to deliver the fire suppression agent while the vehicle is still moving, albeit at a very low velocity. This prevents the rear wheels of the vehicle from shadowing, or blocking dispersion of fire suppressant agent 22. Also, in many cases, a vehicular fire may not become well-established until the vehicle comes to a halt.

Figure 10:
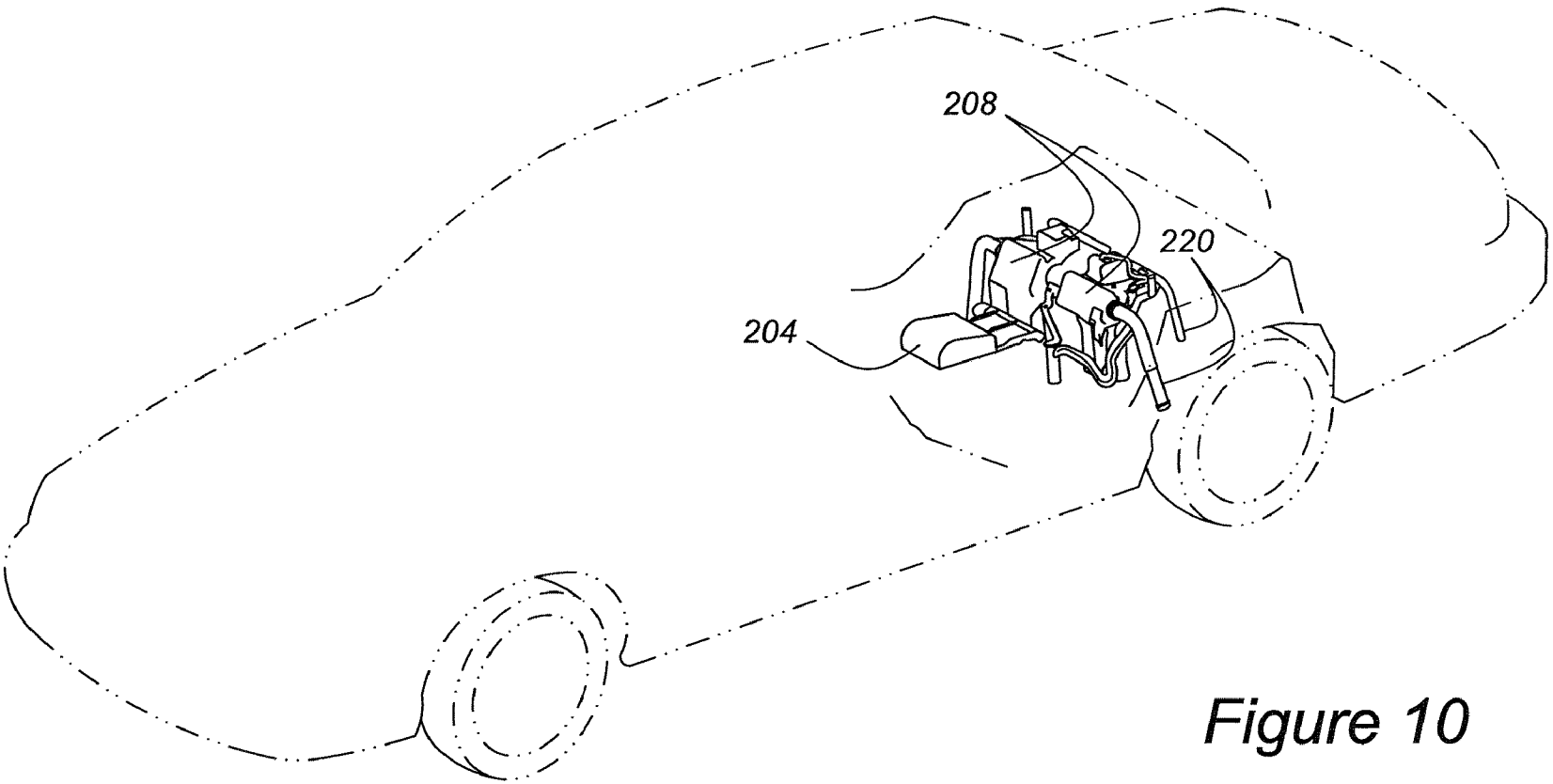
FIG. 10 is a perspective view of a vehicle having a fire suppression system with an internally reinforced reservoir according to one aspect of the present invention.

As shown in FIG. 10, vehicle 200 has a controller 204 which operates to discharge suppression agent 216 contained within reservoirs 208 (FIG. 11), through distribution system 220.

Figure 11:
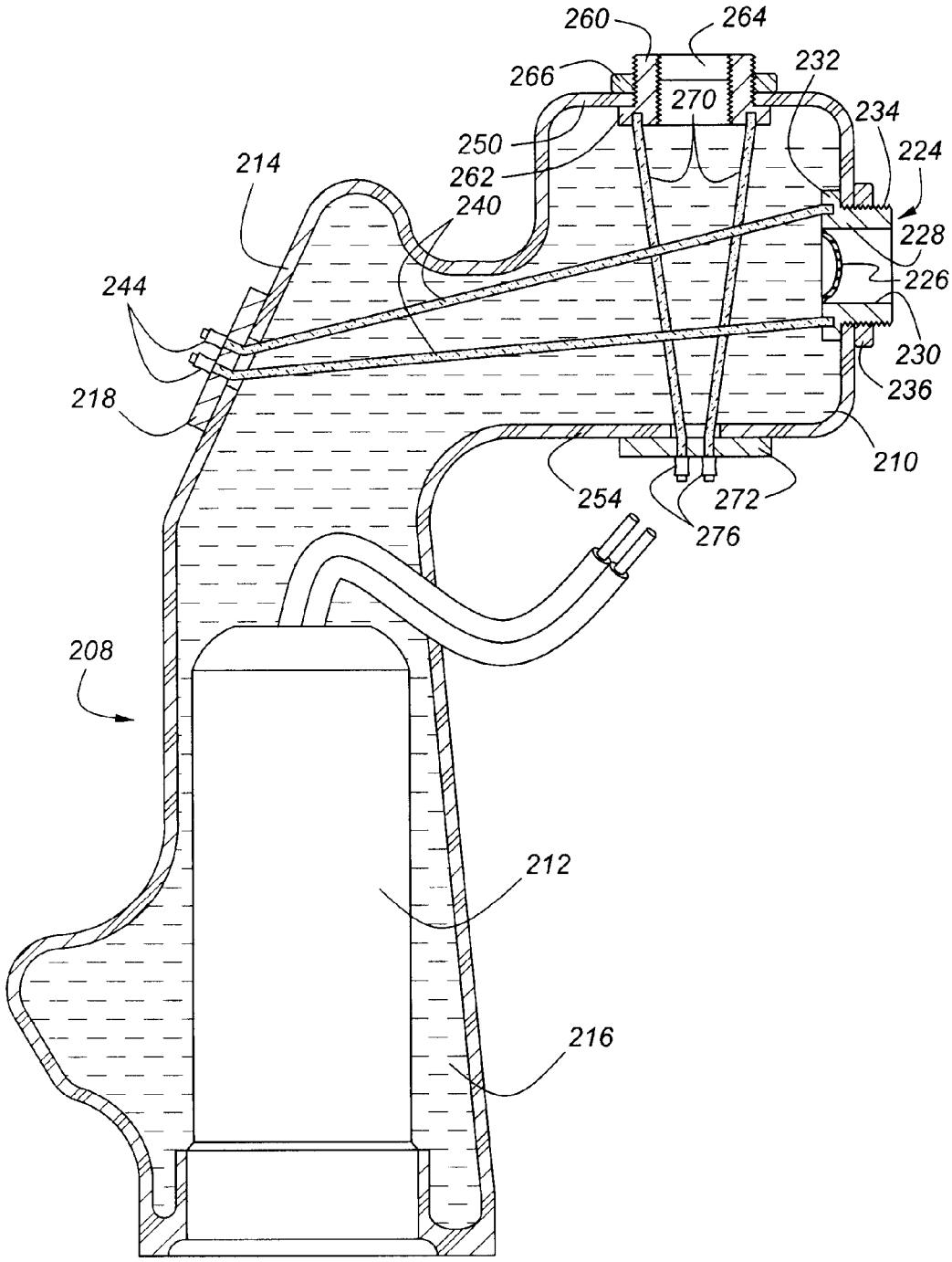
FIG. 11 is a cutaway view of a suppression agent reservoir according to one aspect of the present invention.
Figure 12:
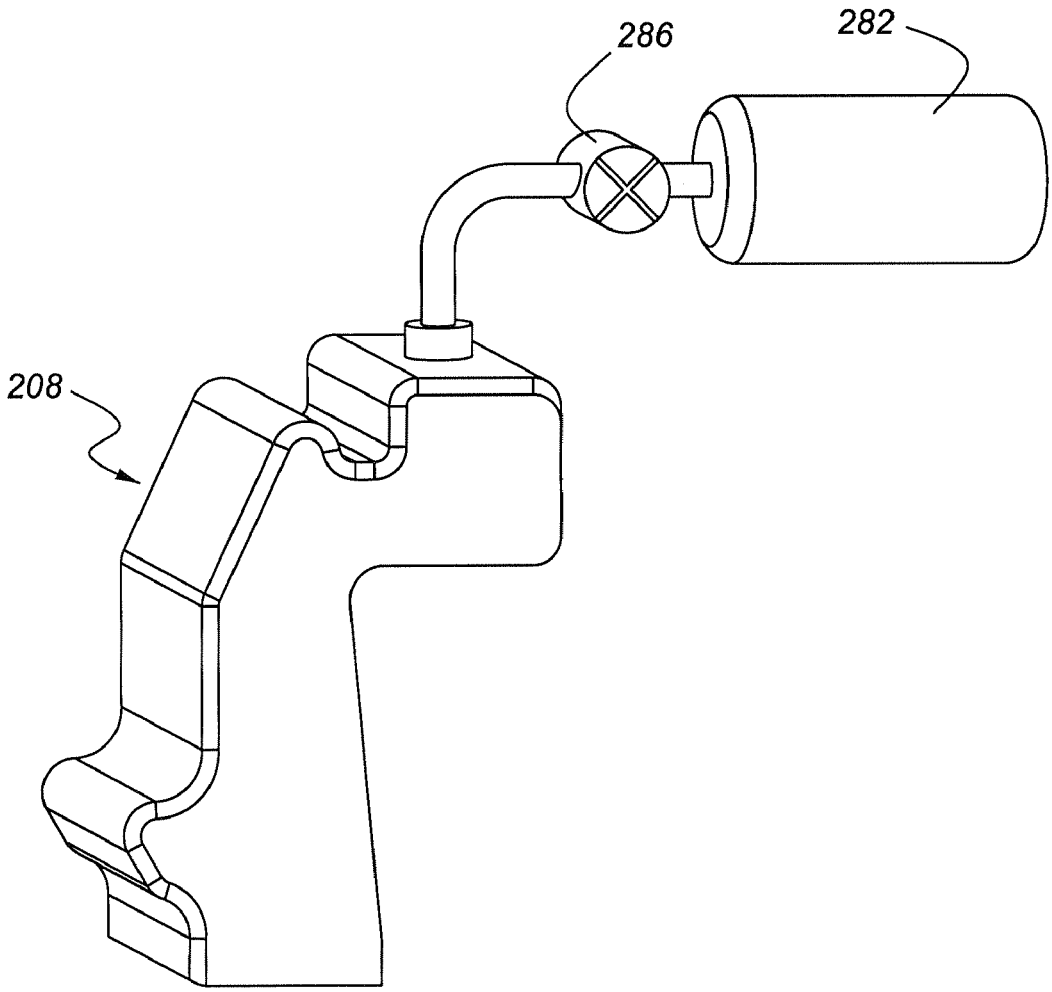
FIG. 12 is a cutaway perspective view of a reservoir having an external propellant according to one aspect of the present invention.

FIG. 11 shows a fiber-reinforced composite reservoir 208 having a first wall section, 210, through which a discharge port, 224, extends. Discharge port 224 has a generally tubular body, 228, defining a passage, 230. Generally tubular body 228 also has an internal flange, 232, which abuts an inner surface of first wall section 210. A threaded fastener, 236, is spun down upon threads 234 formed on an external tubular surface of discharge port 224, so as to provide an abutment for applying the pre-tensioning force provided by cable elements 240. Cable elements 240 maintain discharge port 224 in registry with first wall section 210. As further shown in FIG. 11, cable elements 240 are tensile members which extend through the interior of reservoir 208 from first wall section 210 through second wall section 214. Cable elements 240 also extend through anchor 218, which is placed on an exterior surface of second wall section 214. Each of cable elements 240 has a first end attached to discharge port 224, and a second end attached to slugs 244 which are crimped upon cables 240. Slugs 244 keep cable elements 240 from becoming slack during the useful life of reservoir 208.

According to another aspect of the present invention, a method for constructing an internally reinforced reservoir for an onboard fire suppression system includes forming reservoir body 208 and extending tensile members 240 from discharge port 224 to second wall section 214, followed by tensioning of tensile members, in this case elements 240, so that cable elements 240 remain in tension during standby operation of reservoir 208.

Discharge port 224 also includes a burst disk 226, which prevents discharge of suppressant agent from reservoir 208 before a predetermined minimum threshold pressure has been released upon firing of propellant 212.

According to another aspect of the present invention, reservoir 208 may optionally include a fill port, having an internal flange, 262, an external threaded fastener 266, and a fill plug 264. Cable elements 270 extend from fill port 260, which is located in third wall section 250 of reservoir 208, through anchor 272, which is located on fourth wall 254 of reservoir 208. Slugs 276 maintain cable elements 270 in their standby position.

Propellant 212 may be optionally replaced by propellant 282 which is located externally of reservoir 208 and which may include a cold gas propellant or other type of propellant, with the gas discharge being controlled by controller 204 and control valve 286.

According to another aspect of the present invention, cable elements 240, discharge port 224, and anchor 218 may be formed as non-metallic members or metallic members. If metallic, these components may be formed from ferrous metals or non-ferrous metals. Those skilled in the art will appreciate in view of this disclosure that various types of metallic and non-metallic and composite materials may be used for the construction of various components such as discharge port 224, cable elements 240, and anchor 218. Such materials may include combinations of metallic and non-metallic components.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. An onboard fire suppression system, comprising:

at least one fiber-reinforced, composite reservoir containing a fire suppressant agent;

a propellant, operatively associated with said reservoir, for expelling the fire suppressant agent from the reservoir;

a discharge port extending through a first wall section of said reservoir;

a distribution system for receiving fire suppressant agent expelled from said reservoir and for distributing the fire suppressant agent in at least one location external to a vehicle, with said distribution system being connected to said discharge port; and a retaining system, located within said reservoir, for maintaining said discharge port in registry with said first wall section, with said retaining system comprising:

an anchor incorporated in a second wall section opposing said first wall section; and a tensile member extending through the interior of said reservoir, with said tensile member being attached to said anchor and to said discharge port.

2. An onboard fire suppression system according to claim 1, wherein said discharge port, said anchor, and said tensile member all comprise metallic members.

3. An onboard fire suppression system according to claim 2, wherein said discharge port, said anchor, and said tensile member all comprise ferrous metals.

4. An onboard fire suppression system according to claim 2, wherein said discharge port, said anchor, and said tensile member all comprise non-ferrous metals.

5. An onboard fire suppression system according to claim 1, wherein said tensile member is pre-tensioned.

6. An onboard fire suppression system according to claim 1, wherein said tensile member comprises a plurality of cable elements, with each cable element having a first end attached to said anchor and a second end attached to said discharge port.

7. An onboard fire suppression system according to claim 1, further comprising a fill port extending through a third wall section of said reservoir.

8. An onboard fire suppression system according to claim 7, further comprising a secondary anchor incorporated in a fourth wall section opposing said third wall section, and a secondary tensile member extending through the interior of said reservoir from said secondary anchor to said fill port.

9. An onboard fire suppression system according to claim 8, wherein said secondary tensile member comprises at least one cable element fastened to said secondary anchor and to said fill port.

10. An onboard fire suppression system according to claim 1, wherein said discharge port comprises a flanged, generally tubular body having a flanged section abutting an inner surface of said first wall section of said reservoir.

11. An onboard fire suppression system according to claim 10, wherein said discharge port further comprises a threaded fastener affixed to a portion of said discharge port abutting an outer surface of said first wall section.

12. An onboard fire suppression system according to claim 1, wherein said discharge port, said anchor, and said tensile member all comprise nonmetallic members.

13. An onboard fire suppression system, comprising:

at least one fiber-reinforced, composite, internally-reinforced reservoir containing a fire suppressant agent;

a propellant, operatively associated with said reservoir, for expelling the fire suppressant agent from the reservoir;

a discharge port extending through a first wall section of said reservoir, with said discharge port comprising an internal flange abutting an interior surface of the first wall section, and an external flange abutting an exterior surface of the first wall section;

a distribution system for receiving fire suppressant agent expelled from said reservoir and for distributing the fire suppressant agent in at least one location external to a vehicle, with said distribution system being connected to said discharge port; and a reinforcement system, located within said reservoir, for maintaining said discharge port in registry with said first wall section, with said reinforcement system comprising:

an anchor incorporated in a second wall section opposing said first wall section; and a plurality of cable elements extending through the interior of said reservoir between said discharge port and said anchor, with said cable elements each having a first end attached to said anchor and a second end attached to said discharge port.

14. An onboard fire suppression system according to claim 13, wherein said cable elements are pretensioned.

15. An onboard fire suppression system according to claim 13, wherein said propellant is located within said reservoir.

16. An onboard fire suppression system according to claim 13, wherein said propellant is located external to said reservoir.

* * * * *